US008575999B2

(12) United States Patent
Akiya

(10) Patent No.: US 8,575,999 B2
(45) Date of Patent: Nov. 5, 2013

(54) CONSTANT CURRENT CIRCUIT AND SEMICONDUCTOR INTEGRATED CIRCUIT

(75) Inventor: Sadanori Akiya, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 13/328,884

(22) Filed: Dec. 16, 2011

(65) Prior Publication Data

US 2012/0086503 A1 Apr. 12, 2012

Related U.S. Application Data

(63) Continuation of application No. PCT/JP2009/062365, filed on Jul. 7, 2009.

(51) Int. Cl.
*G05F 1/10* (2006.01)
*G05F 3/02* (2006.01)

(52) U.S. Cl.
USPC ..... 327/543

(58) Field of Classification Search
USPC ..... 327/538, 540, 541, 543; 323/315
See application file for complete search history.

(56) References Cited

U.S. PATENT DOCUMENTS

| | | | | |
|---|---|---|---|---|
| 6,686,797 | B1 * | 2/2004 | Eker | 327/539 |
| 7,307,470 | B2 * | 12/2007 | Hasegawa | 327/543 |
| 2005/0068072 | A1 | 3/2005 | Iorga | |
| 2006/0192611 | A1 * | 8/2006 | Bonaccio et al. | 327/543 |

FOREIGN PATENT DOCUMENTS

| | | |
|---|---|---|
| EP | 1 017 164 | 7/2000 |
| JP | 57-81621 | 5/1982 |
| JP | 9-319323 | 12/1997 |
| JP | 2000-201032 | 7/2000 |
| JP | 2005-234890 | 9/2005 |
| JP | 2006-140888 | 6/2006 |
| JP | 2007-507044 | 3/2007 |
| JP | 2007-280322 | 10/2007 |
| WO | WO 2005/031489 | 4/2005 |

OTHER PUBLICATIONS

Patent Abstracts of Japan, Publication No. 09-319323, Published Dec. 12, 1997.
Patent Abstracts of Japan, Publication No. 2005-234890, Published Sep. 2, 2005.
Patent Abstracts of Japan, Publication No. 2006-140888, Published Jun. 1, 2006.
Patent Abstracts of Japan, Publication No. 2007-280322, Published Oct. 25, 2007.

(Continued)

*Primary Examiner* — Quan Tra

(57) ABSTRACT

In a constant current circuit, a drain terminal is connected to an output terminal of a current, and a gate voltage operable in a saturation region is applied to a source-grounded transistor. An increase current generating circuit generates an increase current equivalent to an increase of a current due to a channel length modulation effect of the transistor. A current mirror circuit generates a current having the same value as that of the increase current generated by the increase current generating circuit and supplies the generated current to the drain terminal of the transistor.

5 Claims, 10 Drawing Sheets

(56) References Cited

OTHER PUBLICATIONS

Patent Abstracts of Japan, Publication No. 2000-201032, Published Jul. 18, 2000.
Patent Abstracts of Japan, Publication No. 57-81621, Published May 21, 1982.
Yui et al., "Proposing Methods of Enhancing the Accuracy of Current Mirror Circuits for Power Supply", IEEJ Technical Report, vol. ECT-09, No. 37-52 (ECT-09-48), pp. 65-68, Mar. 26, 2009.
International Search Report mailed Sep. 15, 2009 in PCT/JP2009/062365.

* cited by examiner

VOLTAGE-DEPENDENT RELATIONSHIP
ACCORDING TO FIRST EMBODIMENT

FIRST COMPARATIVE EXAMPLE

VOLTAGE-DEPENDENT RELATIONSHIP
OF FIRST COMPARATIVE EXAMPLE

SECOND COMPARATIVE EXAMPLE

VOLTAGE-DEPENDENT RELATIONSHIP OF
SECOND COMPARATIVE EXAMPLE

CONSTANT CURRENT CIRCUIT AND SEMICONDUCTOR INTEGRATED CIRCUIT

This application is a continuing application, filed under 35 U.S.C. §111(a), of International Application PCT/JP2009/062365, filed on Jul. 7, 2009.

FIELD

The embodiment discussed herein is related to a constant current circuit and a semiconductor integrated circuit.

BACKGROUND

When a constant current of an output current from a current source is realized in an electronic circuit, a constant current circuit is used. As the constant current circuit, a circuit using a metal-oxide-semiconductor field-effect transistor (MOSFET) is used. As the constant current circuit using the MOSFET, two examples will be mainly described below.

A first constant current circuit uses a source-grounded MOSFET. A gate-to-source voltage of the source-grounded MOSFET is fixed, and the MOSFET operates in a saturation region. Through this processing, the first constant current circuit is used as a constant current circuit.

A second constant current circuit is a cascode current source using a source-grounded MOSFET and a gate-grounded MOSFET.

As can be seen from the above discussion, two main constant current circuits are used, and each of the constant current circuits has the following defects.

In the first constant current circuit, the MOSFET operates in the saturation region. The constant current circuit exerts a channel length modulation effect in the saturation region. Due to the above channel length modulation effect, as an output voltage becomes higher, an output current becomes larger. As a result, there is a problem that output voltage dependence of the output current is large (output resistance is small).

In the second constant current circuit, when two MOSFETs stacked in two stages operate in the saturation region, output voltage dependence of the output current can be reduced (output resistance can be enlarged). Note that when both of two MOSFETs operate in the saturation region, a high output voltage is necessary as compared with a case of one MOSFET. Therefore, there is the following problem. That is, although the output voltage dependence of the output current can be reduced in the second constant current circuit, a lower limit of an operable output voltage range of a constant current circuit becomes high as compared with a first conventional example.

As can be seen from the above discussion, the two constant current circuits each have defects. For the purpose of removing the above defects, various constant current circuits are considered. For example, there is used a constant current drive circuit in which when a variable resistor arranged in a predetermined position operates in conjunction with the output voltage, even if an external load changes, an output current fails to change and a stabilized constant current can be provided also in the saturation region with a low voltage.

Japanese Laid-open Patent Publication No. 09-319323
Japanese Laid-open Patent Publication No. 2005-234890
Japanese Laid-open Patent Publication No. 2006-140888
Japanese Laid-open Patent Publication No. 2007-280322

However, in the conventional technology, when voltage dependence of the output current is reduced and a constant current circuit is operable also at the low output voltage, a circuit configuration of the constant current circuit becomes complicated. In the constant current drive circuit in which a variable resistor arranged in the predetermined position operates in conjunction with the output voltage, for example, another constant current source is necessary. In addition, a control circuit which gears the variable resistor to the output voltage is necessary and the entire circuit becomes complicated.

SUMMARY

According to one aspect of the present invention, a constant current circuit includes a source-grounded transistor a drain terminal of which is connected to an output terminal of a current; an increase current generating circuit to generate an increase current equivalent to an increase of a current due to a channel length modulation effect of the transistor; and a current mirror circuit to generate a current having the same value as that of the increase current generated by the increase current generating circuit and supply the generated current to the drain terminal of the transistor.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1:
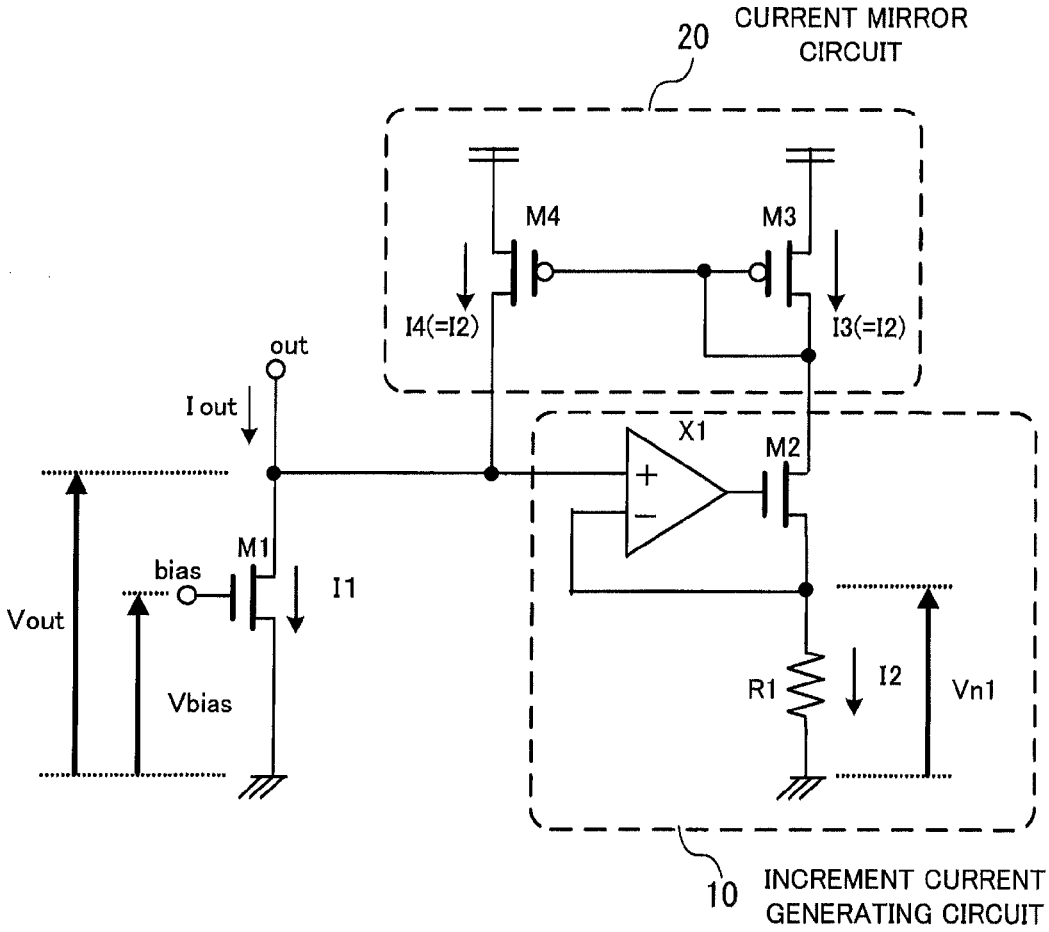
FIG. 1 illustrates a constant current circuit according to a first embodiment.

Preferred embodiments of the present invention will now be described in detail below with reference to the accompanying drawings, wherein like reference numerals refer to like elements throughout.

First Embodiment

FIG. 1 illustrates a constant current circuit according to a first embodiment. Between a ground and an output terminal out in which an, output current (Iout) flows from an external load, an n MOSFET (M1) is connected. In the MOSFET (M1), a drain terminal is connected to the output terminal out and a source terminal is connected to the ground. To a gate terminal of the MOSFET (M1), a predetermined gate voltage (Vbias) is applied.

To the output terminal out, an increase current generating circuit 10 is connected. The increase current generating circuit 10 generates a current I2 equivalent to the increase of a current I1 due to a channel length modulation effect in the MOSFET (M1).

On the increase current generating circuit 10, an amplifier circuit X1 is provided. The above amplifier circuit X1 is an operational amplifier circuit operating due to a potential difference between two inputs. A noninverted input terminal (+) of the amplifier circuit X1 is connected to a junction provided between the output terminal out and the drain terminal of the MOSFET (M1). An output terminal of the amplifier circuit X1 is connected to a gate terminal of an n MOSFET (M2). A drain terminal of the MOSFET (M2) is connected to a current mirror circuit 20. A source terminal of the MOSFET (M2) is connected to an inverted input terminal (−) of the amplifier circuit X1. This processing permits an imaginary short of the amplifier circuit X1 to be formed. In addition, the source terminal of the MOSFET (M2) is connected also to the ground via a resistor R1. A resistance value r1 of the resistor R1 is equivalent to an inverse number (1/λ) of a channel length modulation coefficient of the MOSFET (M1).

The current mirror circuit 20 reduces the current I2 generated by the increase current generating circuit 10 from a drain current of the MOSFET (M1). On the current mirror circuit 20, two MOSFETs (M3 and M4) in which both of gate terminals are connected to each other are provided. A source terminal of the MOSFET (M3) is connected to a power source. Further, a drain terminal of the MOSFET (M3) is connected to the gate terminal of the MOSFET (M4) as well as to the drain terminal of the MOSFET (M2) of the increase current generating circuit 10.

A source terminal of the MOSFET (M4) is connected to a power source. A drain terminal of the MOSFET (M4) is connected to the drain terminal of the MOSFET (M1) via wiring between the output terminal out and the noninverted input terminal of the amplifier circuit X1.

In the above-described constant current circuit, the gate voltage (Vbias) of the MOSFET (M1) is fixed to a predetermined value. The current I1 being the drain current of the MOSFET (M1) the source terminal of which is connected to the ground increases in proportion to a source-to-drain voltage (Vout) by using as a proportionality coefficient the channel length modulation coefficient (λ). Note that an output voltage of the external load connected to the output terminal out serves as the source-to-drain voltage (Vout) of the MOSFET (M1).

Here, when the output voltage is applied to the output terminal out, the increase current generating circuit 10 permits the current I2 the same as the increase of a current to be generated due to the channel length modulation effect of the MOSFET (M1). Referring to an example of FIG. 1, due to an imaginary short of the amplifier circuit X1, a potential difference Vn1 between both ends of the resistor R1 becomes equivalent to the source-to-drain voltage (V out) of the MOSFET (M1) (Vn1=Vout). Here, the resistance value r1 of the resistor R1 is equivalent to an inverse number (1/λ) of a channel length modulation coefficient of the MOSFET (M1). Therefore, the current I2 flowing through the resistor R1 has a value obtained by multiplying the source-to-drain voltage (Vout) by the channel length modulation coefficient (λ) based on Ohm's law (current value=voltage value/resistance value).

In the case where the current I2 flows through the increase current generating circuit 10, a current I3 with the same value as that of the current I2 flows from the source terminal also to the drain terminal of the MOSFET (M3) of the current mirror circuit 20. As a result, also from the source terminal to the drain terminal of the MOSFET (M4) making a pair with the MOSFET (M3), a current I4 with the same value as that of the current I2 flows. That is, by the current mirror circuit 20, the current I3 with the same value as that of the current I2 is copied, and as a result, a current I4 with the same value as that of the current I2 is generated. The generated current I4 is supplied to the drain terminal of the MOSFET (M1).

Further, the output current Iout supplied from the output terminal out is supplied to the drain terminal of the MOSFET (M1). After all, to the drain terminal of the MOSFET (M1), the output current Iout and the current are supplied. Here, a value of the current I4 is equivalent to that of the current I2. Namely, based on Kirchhoff's law, the current I1 is obtained by adding the current I2 to the output current Iout. When the above relationship is represented by formula for calculating the output current Iout, the formula "Iout=I1−I2" is obtained.

Here, the current I2 is equivalent to the increase of the current I1 due to the channel length modulation effect in the MOSFET (M1). Accordingly, the formula "Iout=I1−I2" represents that the increase of the current I1 due to the channel length modulation effect is canceled out by the current I2.

Figure 2:
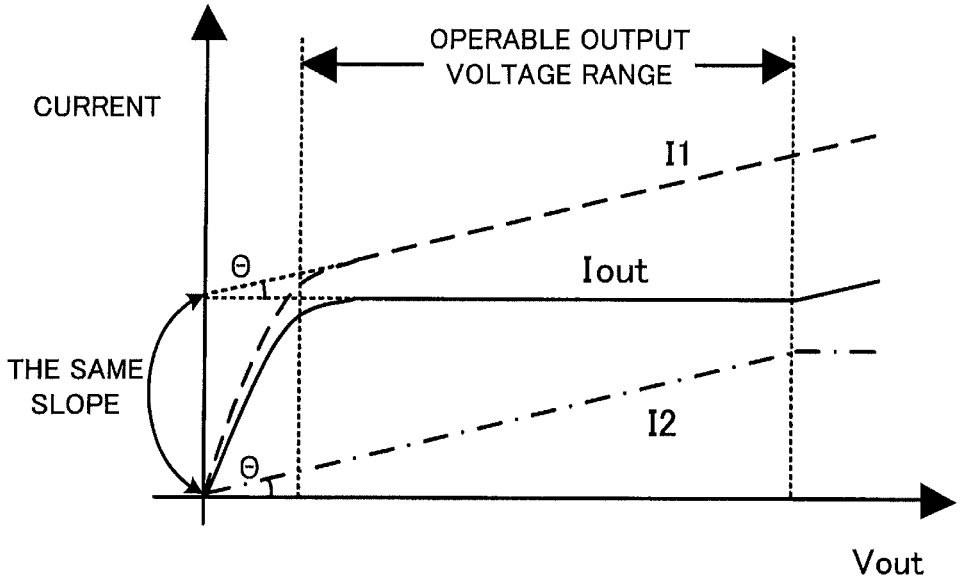
FIG. 2 illustrates a voltage-dependent relationship relating to an output current according to a first embodiment.

FIG. 2 illustrates a voltage-dependent relationship relating to the output current according to the first embodiment. In FIG. 2, the horizontal axis represents the source-to-drain voltage (Vout) of the MOSFET (M1), and the vertical axis represents the current value. The current I1 is indicated by a broken line, the current I2 is indicated by a chain line, and the output current Tout is indicated by a solid line.

As illustrated in FIG. 2, lines indicating the currents I1 and I2 have approximately the same slope 8 as each other in the operable output voltage range of the constant current circuit. Since the output current Iout has a value obtained by reducing the current I2 from the current I1, the slope is approximately equivalent to zero in the operable output voltage range of the constant current circuit. As a result, it is found that the output current Iout is kept constant.

Note that the operable output voltage range of the constant current circuit means a range of the source-to-drain voltage (Vout) capable of operating the MOSFET (M1) in the saturation region. A lower limit of the operable output voltage range of the constant current circuit indicates a minimum voltage necessary for operating the MOSFET (M1) in the saturation region. On the other hand, an upper limit of the operable output voltage range of the constant current circuit indicates a maximum voltage in which the current mirror circuit 20 is capable of properly performing an operation.

Next, a difference of the voltage-dependent relationship between other constant current circuits and the constant current circuit according to the first embodiment will be described with reference to examples of two constant current circuits.

Figure 3:
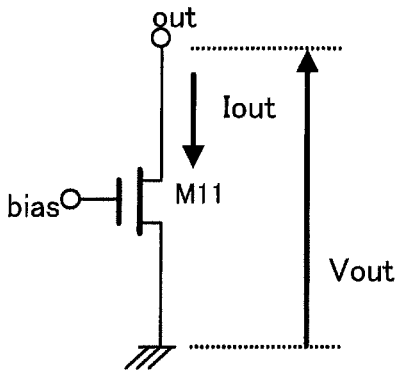
FIG. 3 illustrates a first comparative example of a constant current circuit.

FIG. 3 illustrates a first comparative example of a constant current circuit. In the first comparative example, the constant current circuit using a source-grounded MOSFET (M11) is represented. When the MOSFET (M11) operates in the saturation region, the constant current of the output current Iout is realized.

Figure 4:
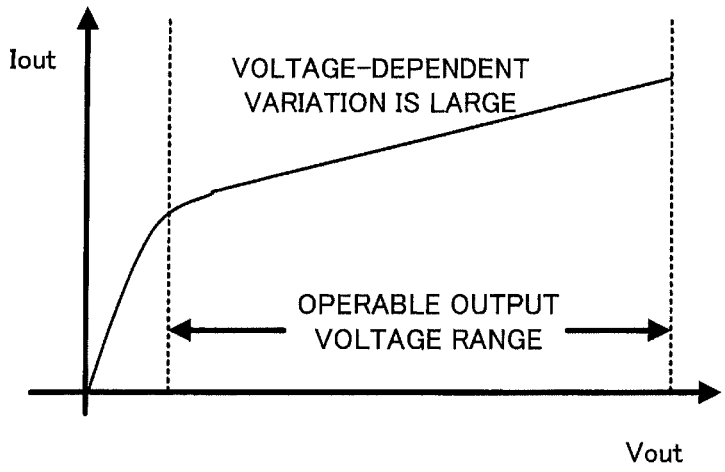
FIG. 4 illustrates a voltage-dependent relationship relating to an output current according to a first comparative example.

FIG. 4 illustrates the voltage-dependent relationship relating to the output current according to the first comparative example. In FIG. 4, the horizontal axis represents the source-to-drain voltage (Vout) of the MOSFET (M11), and the vertical axis represents a current value of the output current Iout. The output current Iout is indicated by a solid line.

In the first comparative example, the channel length modulation effect of the MOSFET (M11) remains. Also in the operable output voltage range of the constant current circuit, as the source-to-drain voltage (Vout) rises more, the output current Iout increases more. Namely, the voltage-dependent variation of the output current Iout is large.

Here, a lower limit of the operable output voltage range of the constant current circuit indicates a minimum voltage necessary for operating the MOSFET (M11) in the saturation region. In the first comparative example, since the MOSFET (M11) is configured by only one stage, the constant current circuit can operate from a relatively low voltage.

Figure 5:
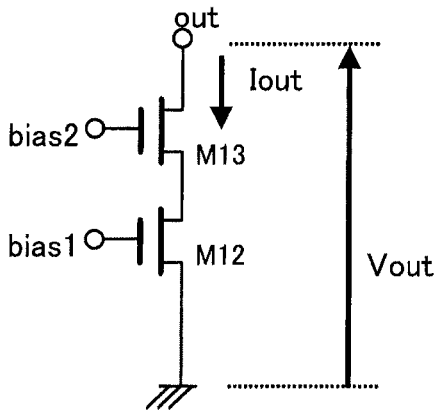
FIG. 5 illustrates a second comparative example of a constant current circuit.

FIG. 5 illustrates a second comparative example of a constant current circuit. In the second comparative example, the constant current circuit which cascode-connects MOSFETs (M12) and (M13) is represented. A source terminal of the MOSFET (M12) is connected to the ground, and a drain terminal thereof is connected to a source terminal of the MOSFET (M13). A drain terminal of the MOSFET (M13) is connected to the output terminal out.

Figure 6:
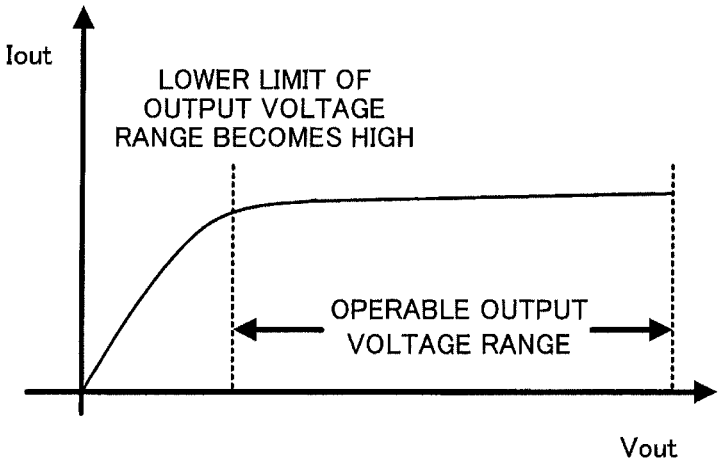
FIG. 6 illustrates a voltage-dependent relationship relating to an output current according to a second comparative example.

FIG. 6 illustrates the voltage-dependent relationship relating to the output current according to the second comparative example. In FIG. 6, the horizontal axis represents the source-to-drain voltage (Vout) being a voltage between the source terminal of the MOSFET (M12) and the drain terminal of the MOSFET (M13), and the vertical axis represents a current value of the output current Iout. In the second comparative example, when the gate-grounded MOSFET is stacked vertically on the source-grounded MOSFET (M12), the output voltage dependence of the output current can be reduced (output resistance can be enlarged). That is, in the operable output voltage range of the constant current circuit, a slope of a line indicating the output current Iout becomes approximately horizontal as compared with the first comparative example. Note that in order that both of the two MOSFETs stacked in two stages may operate in the saturation region, a high potential difference need to be used as compared with a case of one MOSFET. Therefore, a lower limit of the operable output voltage range of the constant current circuit becomes high as compared with the first comparative example.

When the voltage-dependent relationships of the first and second comparative examples illustrated in FIGS. 4 and 6 are compared with that of the first embodiment illustrated in FIG. 2, defects of the first and second comparative examples are solved in the first embodiment.

That is, in the constant current circuit using the n MOSFET (M1) according to the first embodiment, a current change due to the channel length modulation effect of the MOSFET (M1) is canceled out by the current I4 having the same value as that of the current I2 generated by using the resistor R1. This processing permits the output voltage dependence of the output current Iout to be reduced. Since the MOSFET (M1) has no cascode structure, a lower limit of the operable output voltage range of the constant current circuit is determined only by a voltage used for operating the MOSFET (M1) in the saturation region. As a result, a lower limit of the output voltage range can be reduced.

In addition, in the constant current circuit according to the first embodiment, another constant current source need not be prepared. Further, a resistance value of the resistor R1 may be a fixed value according to the channel length modulation coefficient (λ) of the MOSFET (M1). That is, also a control circuit for operating a resistance value in conjunction with the output voltage is unnecessary. Therefore, the constant current circuit according to the first embodiment can be sufficiently used by a simple circuit configuration.

Incidentally, a constant current circuit is integrated into a large-scale integrated circuit (LSI) in many cases. For the purpose of improving an operation speed or a degree of integration, a gate length of a MOSFET becomes short in a recent LSI. When a gate length becomes short, the voltage dependence tends to become large in the saturation region of the MOSFET. In other words, a slope of the current I1 becomes large in the operable output voltage range of the constant current circuit. As a result, when the MOSFETs are only cascode-connected as in the second comparative example illustrated in FIG. 5, it is supposed to become difficult to sufficiently reduce an output voltage dependence of the output current due to a further high degree of integration of future LSI.

On the other hand, in the constant current circuit according to the first embodiment, when the slope of the current I1 of FIG. 2 is canceled out by the current I2, the output current Iout in which an influence from the output voltage is minimized can be acquired. Therefore, the gate length becomes short and the slope of the current I1 becomes large. In the above-described case, when a resistance value of the resistor R1 is set according to the case, the output current Iout can be kept constant in the operable output voltage range of the constant current circuit. As a result, the constant current circuit according to the first embodiment is appropriate to the mounting onto an LSI with a high degree of integration.

Further, there is a problem that in various devices such as computers mounting electronic components, power consumption increases along with performance improvement. An operation voltage of electronic components tends to be reduced in order to suppress power consumption. The constant current circuit according to the first embodiment is operable at a low voltage and can make a contribution to electrical power saving of electronic devices.

Second Embodiment

Next, a second embodiment will be described. According to the second embodiment, a gate voltage of the MOSFET (M1) is controlled by a current from another current source.

Figure 7:
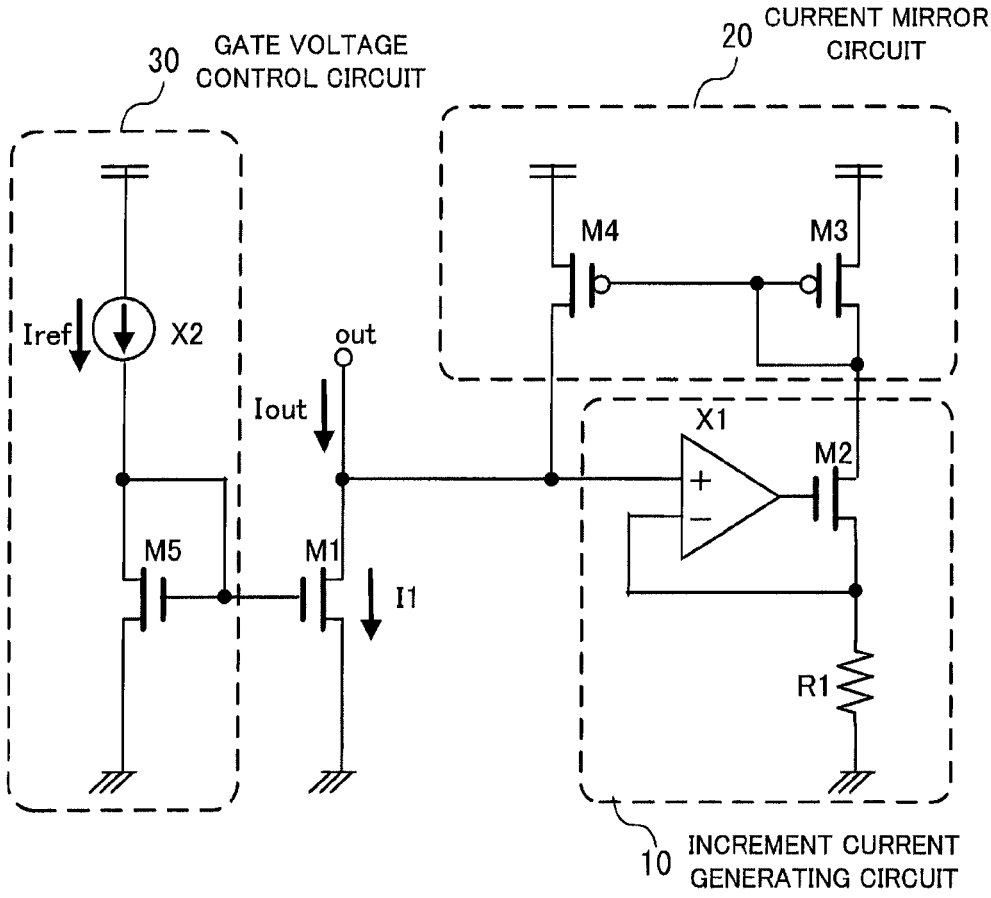
FIG. 7 illustrates a constant current circuit according to a second embodiment.

FIG. 7 illustrates a constant current circuit according to the second embodiment. According to the second embodiment, a gate voltage control circuit 30 is added to the constant current circuit according to the first embodiment of FIG. 1. All circuit elements except those of the gate voltage control circuit 30 are indicated by the same reference numerals as in the first embodiment, and the description will not be repeated here.

In the gate voltage control circuit 30, an output from a constant current circuit X2 connected to a power source is connected to a gate terminal and a drain terminal of an n MOSFET (M5). The gate terminal of the MOSFET (M5) is connected to the gate terminal of the MOSFET (M1). This processing permits a current mirror circuit including the MOSFETs (M5) and (M1) to be configured. A source terminal of the MOSFET (M5) is connected to the ground.

Based on the constant current circuit having the above configuration, the gate voltage of the MOSFET (M1) is controlled by the current Iref output from the constant current circuit X2. The current I1 flowing through the drain terminal of the MOSFET (M1) is a current proportional to the current Iref. The other operations are performed in the same manner as in the first embodiment.

As can be seen from the above sequence, the constant current circuit which controls the gate voltage of the MOSFET (M1) by using the constant current circuit X2 can be realized by using a simple circuit configuration. Here, a lower limit of the operable output voltage range of the constant current circuit is reduced, and the degree of voltage dependence of the output current Iout can be reduced in the same manner as in the first embodiment.

In addition, these features of the second embodiment permit the constant current circuit to operate at a low output voltage and reduce the output voltage dependence of the output current Iout by using the increase current generating circuit 10 and the current mirror circuit 20. Therefore, the gate voltage of the MOSFET (M1) is controlled by a current from another current source. Further, the above control need not be geared to the output voltage and the circuits are not complicated.

Third Embodiment

Next, a third embodiment will be described. A constant current circuit of the third embodiment has a configuration in which an upper limit of the output voltage is widened so that the current mirror circuit 20 of the first embodiment can perform an operation.

Figure 8:
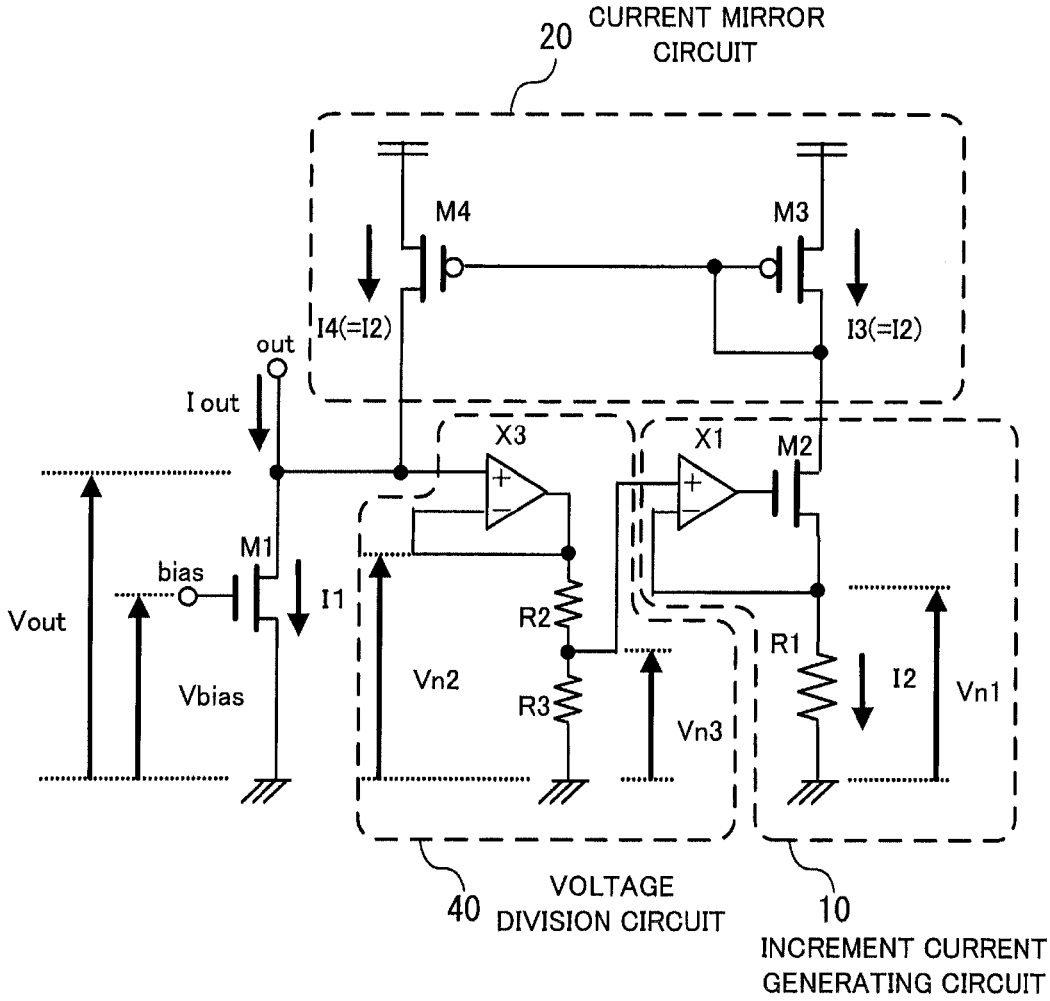
FIG. 8 illustrates a constant current circuit according to a third embodiment.

FIG. 8 illustrates the constant current circuit according to the third embodiment. In the constant current circuit according to the third embodiment, a voltage division circuit 40 is added to the constant current circuit according to the first embodiment of FIG. 1. All circuit elements except those of the voltage division circuit 40 are indicated by the same reference numerals as in the first embodiment, and the description will not be repeated here.

The voltage division circuit 40 is provided between a noninverted input terminal of the amplifier circuit X1 and other circuit elements. On the voltage division circuit 40, an amplifier circuit X3 is provided. The amplifier circuit X3 is an operational amplifier circuit. To the noninverted input terminal (+) of the amplifier circuit X3, the output terminal out is connected. The drain terminal of the MOSFET (M4) of the current mirror circuit 20 is connected to the drain terminal of the MOSFET (M1) via a junction provided between the output terminal out and the noninverted input terminal (+) of the amplifier circuit X3. The output terminal of the amplifier circuit X3 is connected to the inverted input terminal (−) of the amplifier circuit X3 itself. This processing permits an imaginary short to be formed.

In addition, the output terminal of the amplifier circuit X3 is connected to one end of a resistor R2. The other end of the resistor R2 is connected to the ground via a resistor R3 as well as to the noninverted input terminal of the amplifier circuit X1 of the increase current generating circuit 10.

By the voltage division circuit 40 having the above-described configuration, the source-to-drain voltage (Vout) of the MOSFET (M1) is divided and the divided voltage is applied to the noninverted input terminal of the amplifier circuit X1. The voltage generated by the voltage division is a voltage obtained by multiplying the source-to-drain voltage (Vout) by a predetermined value (positive real number less than one).

Specifically, the amplifier circuit X3 functions as a voltage buffer. This processing permits a voltage Vn2 of an output terminal of the amplifier circuit X3 to become equivalent to the output voltage Vout (Vn2=Vout). The resistors R2 and R3 serially connected to the output terminal of the amplifier circuit X3 serve as a voltage division circuit. Namely, a voltage Vn3 supplied to the amplifier circuit X1 is determined by a ratio of resistance values of the resistors R2 and R3. Due to the imaginary short of the amplifier circuit X1, the voltage Vn3 becomes equivalent to the voltage Vn1 of the increase current generating circuit 10. When the resistance values of the resistors R2 and R3 are set to r2 and r3, respectively, formula voltage Vn1=Vout×(r3/(r2+r3)) holds. For example, when r2=9×r3, formula voltage Vn1=Vout×0.1 holds.

In the third embodiment, the resistance value r1 of the resistor R1 of the increase current generating circuit 10 is obtained by multiplying an inverse number of the channel length modulation coefficient (λ) by a voltage division ratio (r3/(r2+r3)) of the voltage division circuit 40. Namely, formula resistance value r1=(1/λ)×(r3/(r2+r3)) is obtained. In the third embodiment, when the resistor R1 of the increase current generating circuit 10 has the resistance value r1, while reducing the voltage Vn1 as compared with the first embodiment, the current I2 equivalent to the increase of the current I1 can be generated due to the channel length modulation effect of the MOSFET (M1).

Figure 9:
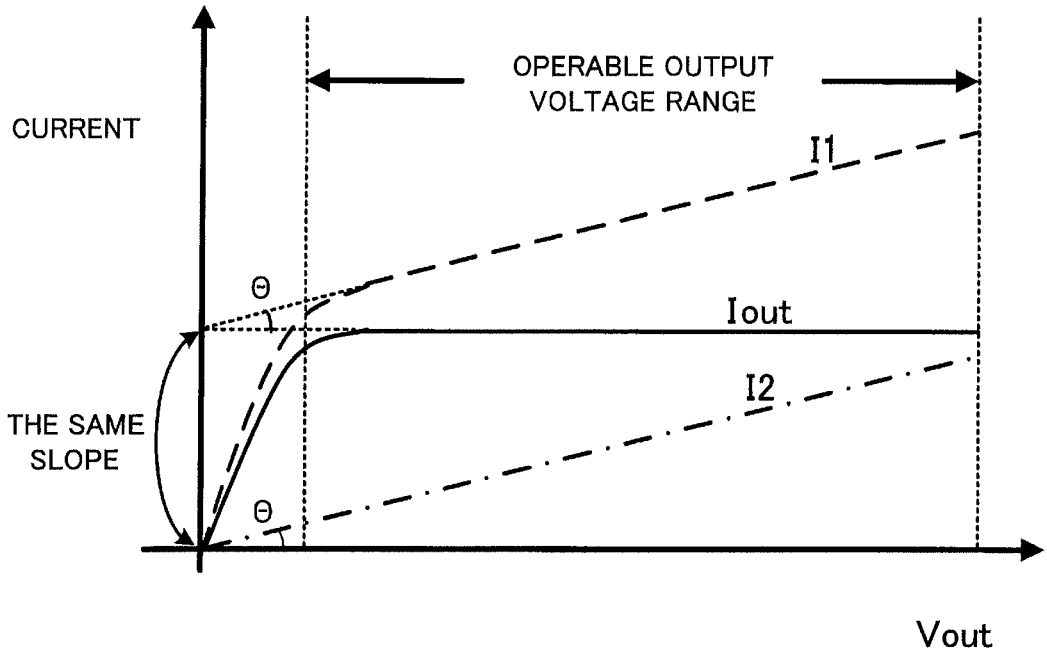
FIG. 9 illustrates a voltage-dependent relationship relating to an output current according to a third embodiment.

FIG. 9 illustrates a voltage-dependent relationship relating to the output current according to the third embodiment. In FIG. 9, the horizontal axis represents the source-to-drain voltage (Vout) of the MOSFET (M1), and the vertical axis represents the current value. The current I1 is indicated by a broken line, the current I2 is indicated by a chain line, and the output current Iout is indicated by a solid line.

As being understood by comparison of FIGS. 9 and 2, in the third embodiment, even if the source-to-drain voltage (Vout) is high, the current mirror circuit 20 operates properly. Therefore, an upper limit of the operable output voltage range of the constant current circuit becomes high. As a result, a line indicating the current I2 runs in parallel to a line indicating the current I1 until the output voltage higher than that of the first embodiment, and the output current Iout is kept constant even in a high output voltage.

As can be seen from the above sequence, the third embodiment provides the constant current circuit which can prevent an operation range of the voltage Vn1 from being reduced and the current mirror circuit 20 including the MOSFETs (M3 and M4) from failing to operate when the output current Iout becomes large. As a result, these features of the present embodiment permit the constant current circuit to widen an upper limit of the output voltage range as compared with the first embodiment.

Fourth Embodiment

In a fourth embodiment, the constant current circuit according to the second embodiment is mounted on a semiconductor integrated circuit. Examples of the semiconductor integrated circuit on which a constant current circuit is mounted include an LSI for realizing a central processing unit (CPU) and a digital signal processor (DSP).

Figure 10:
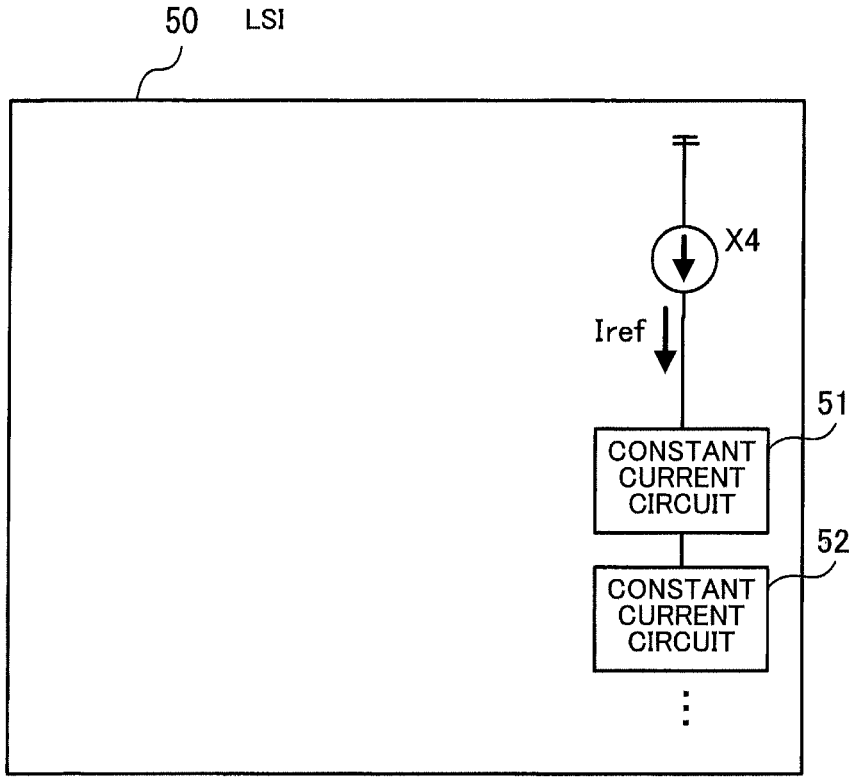
FIG. 10 illustrates an example of an LSI according to a fourth embodiment.

FIG. 10 illustrates an example of an LSI according to the fourth embodiment. In the LSI 50, a plurality of constant current circuits 51, 52, . . . are connected to a constant current circuit X4. The constant current circuit X4 corresponds to the constant current circuit X2 of the constant current circuit according to the second embodiment of FIG. 7. Further, the constant current circuits 51, 52, . . . are a circuit obtained by removing the constant current circuit X2 from the constant current circuit according to the second embodiment of FIG. 7.

A current Iref supplied from the constant current circuit X4 is supplied to current mirror circuits (circuit corresponding to the MOSFETs (M1 and M5) of FIG. 7) of the constant current circuits 51, 52, . . . . Through this processing, when the current Iref produced from the constant current circuit X4 is controlled, a gate voltage of the MOSFET (M1) of each of the constant current circuits 51, 52, . . . can be controlled.

In addition, when the constant current circuit X4 is shared by the plurality of constant current circuits 51, 52, . . . , a simplification of the circuit is realized.

FIG. 10 illustrates an example where the constant current circuits according to the second embodiment are mounted on the LSI 50. In the same manner, also the constant current circuits according to the first and third embodiments can be mounted on an LSI. In the above case, the constant current circuit X4 is unnecessary.

Other Application Examples

The current mirror circuit 20 according to the above embodiments may be substituted into a Wilson or cascode-structure current mirror circuit.

In the above-described embodiment, a constant current circuit in which the n MOSFET (M1) is source-grounded is used. The present embodiment can be applied also to a constant current circuit in which a p MOSFET is source-grounded.

While the above description has assumed that a constant current circuit is configured by using a source-grounded MOSFET a drain terminal of which is connected to an output terminal of a current, the above embodiment is not limited to that configuration. The present embodiment can be applied also to a constant current circuit using other transistors having a channel length modulation effect, except the above MOSFET. Suppose, for example, that in a constant current circuit using a unipolar transistor except a MOSFET, the unipolar transistor has a channel length modulation effect. In the above case, when having the same circuit configuration as in the above embodiments, a constant current circuit can cancel out a channel length modulation effect.

While having a relatively simple circuit configuration, the proposed constant current circuit can reduce an output voltage dependence of an output current and suppress a lower limit of an operable output voltage range of the constant current circuit.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that various changes, substitutions and alterations could be made hereto without departing from the spirit and scope of the invention.

What is claimed is:

1. A constant current circuit comprising:

a source-grounded transistor whose drain terminal is connected to an output terminal of a current;

an increase current generating circuit to generate an increase current equivalent to an increase of a current due to a channel length modulation effect of the transistor;

a current mirror circuit to generate a current having a same value as that of the increase current generated by the increase current generating circuit and supply the generated current to the drain terminal of the transistor; and a gate voltage control circuit to control a voltage applied to a gate terminal of the transistor by a current from another current source.

2. The constant current circuit according to claim 1, wherein the increase current generating circuit imaginarily shorts an amplifier circuit connected to the output terminal to generate the same voltage as the source-to-drain voltage of the transistor.

3. The constant current circuit according to claim 1, wherein the gate voltage control circuit includes another transistor in which both of gate terminals are connected between the another transistor and the transistor, and a current source which supplies a predetermined current to a drain terminal and gate terminal of the another transistor.

4. A constant current circuit comprising:

a source-grounded transistor whose drain terminal is connected to an output terminal of a current;

an increase current generating circuit to generate an increase current equivalent to an increase of a current due to a channel length modulation effect of the transistor;

a current mirror circuit to generate a current having a same value as that of the increase current generated by the increase current generating circuit and supply the generated current to the drain terminal of the transistor; and a voltage division circuit to divide the source-to-drain voltage of the transistor into a voltage having a value obtained by multiplying the source-to-drain voltage of the transistor by a predetermined number, wherein the increase current generating circuit applies a voltage generated by the voltage division circuit to a resistor in which a value obtained by multiplying an inverse number of a channel length modulation coefficient of the transistor by the predetermined number is set as a resistance value to thereby generate the increase current.

5. A semiconductor integrated circuit comprising:

a constant current circuit which is mounted on the semiconductor integrated circuit, wherein the constant current circuit includes:

a source-grounded transistor whose drain terminal is connected to an output terminal of a current;

an increase current generating circuit to generate an increase current equivalent to an increase of a current due to a channel length modulation effect of the transistor; and a current mirror circuit to generate a current having a same value as that of the increase current generated by the increase current generating circuit and supply the generated current to the drain terminal of the transistor, a plurality of the constant current circuits; and a current source for supplying a constant current to each of the plurality of constant current circuits, wherein each of the plurality of constant current circuits further includes a gate voltage control circuit to control a voltage applied to a gate terminal of the transistor by a current from the current source.

* * * * *